United States Patent [19]

Morantz et al.

[11] 4,027,394

[45] June 7, 1977

[54] DRAPERY LENGTH MARKING DEVICE

[76] Inventors: Herbert Morantz, 1444 Wistar Drive, Wyncote, Pa. 19095; Stanley Morantz, 425 Larkspur St., Philadelphia, Pa. 19116

[22] Filed: Nov. 12, 1975

[21] Appl. No.: 631,019

[52] U.S. Cl. ..... 33/18 R; 223/1.1; 118/76; 118/323; 118/502

[51] Int. Cl.[2] ..... B43L 13/00

[58] Field of Search ..... 33/11, 18 R, 32 D, 32 G; 223/1.1; 118/76, 323, 502

[56] References Cited

UNITED STATES PATENTS

| | | | |
|---|---|---|---|
| 3,738,007 | 6/1973 | Tuskos | 33/18 R |
| 3,749,051 | 7/1973 | Sumner et al. | 68/205 R X |

*Primary Examiner*—Charles E. Phillips
*Attorney, Agent, or Firm*—Caesar, Rivise, Bernstein & Cohen, Ltd.

[57] ABSTRACT

A drapery length marking device having a ceiling bar and a drapery length indicator each of which is disposed generally horizontally and can be moved up and down to desired positions by crank means. The ceiling bar has a series of extending pins to enable quick and accurate securement of a drapery whose hem is to be marked. The drapery length indicator is precisely positioned by operation of knobs and can be inclined, if necessary, where an inclined hem is to be made. The drapery length indicator possesses a marking ledge so that an ultraviolet pencil or other marking tool can be pressed upon the drapery against the marking ledge to make a precise line corresponding to the location of the hem. The drapery length indicator also possesses an inner marking ledge so that the hem on the lining of the drapery can be marked. The invention is preferably operated by a cranking system to lessen cost. The ceiling bar is provided with an extension piece for squaring purposes and the drapery length indicator is provided with an extension for use in making deeper hems.

10 Claims, 19 Drawing Figures

DRAPERY LENGTH MARKING DEVICE

This invention relates to a drapery length marking device and more particularly to a new and improved device of this general class.

It is known to provide drapery manufacturing and marking apparatus of the type shown in U.S. Pat Nos. 3,783,007, 3,749,051 and 3,837,890. Such devices rely upon motorized operation and are expensive in view of their complexity which makes for heavy and cumbursome apparatus.

It is accordingly an object of the present invention to provide a drapery length marking device which overcomes the objections of the prior art by providing a ceiling bar which is easily raised and lowered in a cranking action. The ceiling bar possess a series of pins for quick and accurate securement of the drapery. The ceiling bar is raised to a fixed vertical height by means of abutment against stops adjacent the top of the device or against intermediate slidable stops for use with shorter draperies. The present invention further provides a simplification of construction and operation in the drapery length indicator whereby the ultraviolet pencil or other marking device is simply slid upon the drapery and in contact with the marking ledge of the drapery length indicator. Such ledge coupled with the adjustment knobs of the drapery length indicator allow a large freedom of adjustment in order to achieve a hem of desired placement. The drapery length indicator is easily controlled by a crank and can be tilted, if necessary, by control of the adjustment knobs.

In view of the foregoing, the present invention has as its prime objective the provision of a drapery length marking device which is relatively low in cost but highly effective in the hem marking process.

Other objects and many of the intended advantages of the invention will become more readily apparent by reference to the various figures of the drawing wherein.

Figure 1:
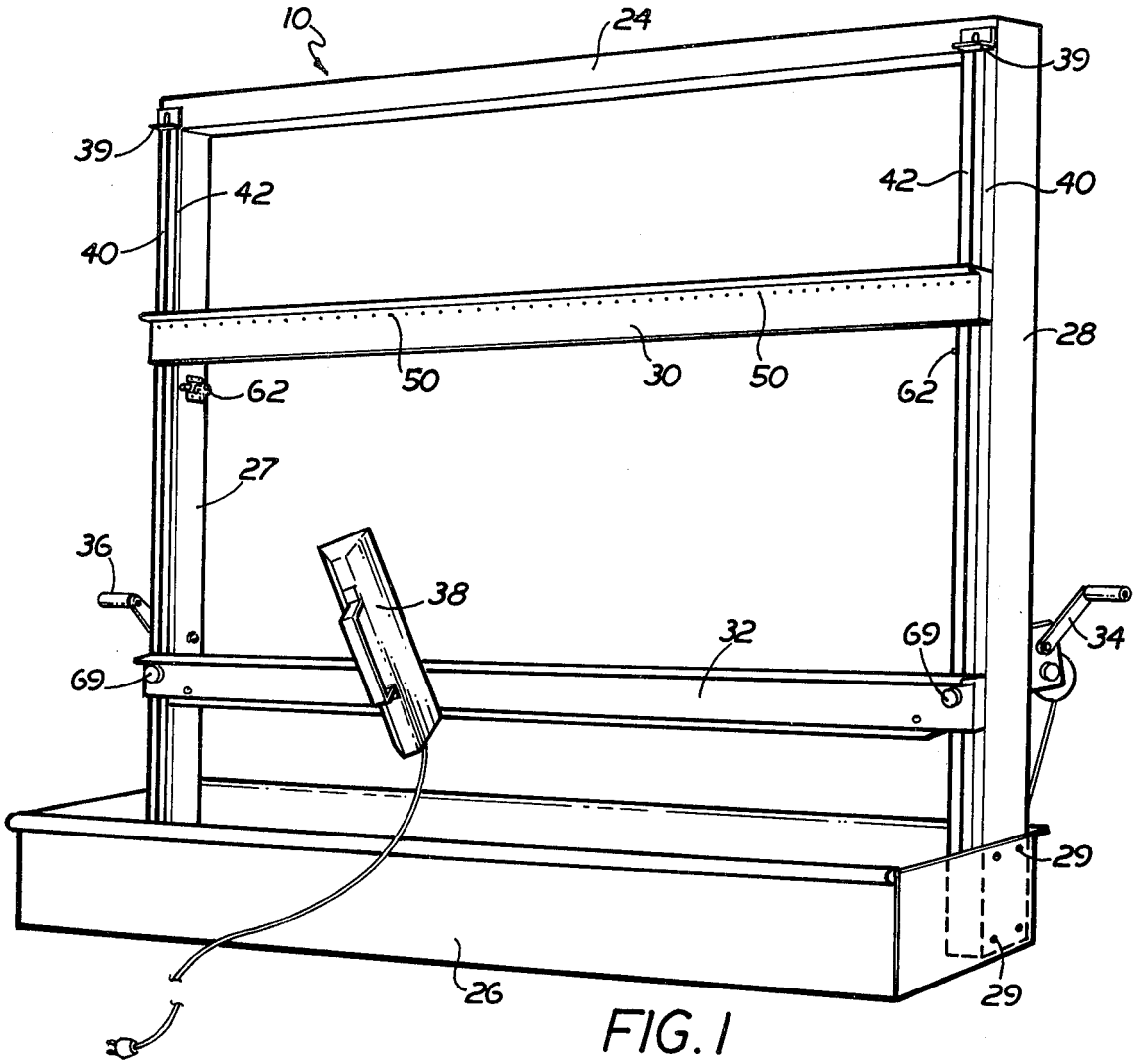
FIG. 1 is a three-dimensional veiw showing the drapery length marking device of the present invention.
Figure 5:
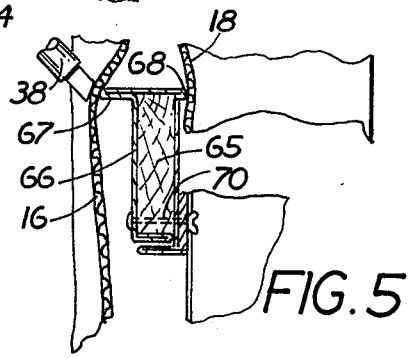
Figure 19:
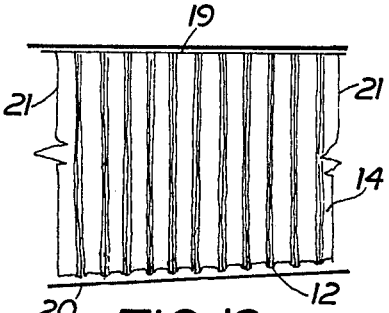
FIG. 19 is an elevational view showing the drapery with a hem marked with the apparatus of the present invention wherein the floor and ceiling is somewhat inclined with respect to each other.
Figure 16:
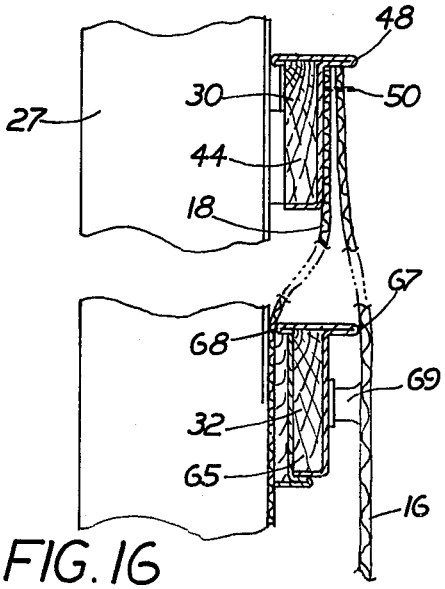
FIG. 16 is a sectional view taken through both the ceiling bar and the drapery length indicator.

Referring now to the various Figures of the drawing, wherein like reference characters refer to like parts, there is shown at 10 in FIG. 1, a drapery length marking device embodying the present invention. The device 10 is used to mark the position of hem 12 of drapery 14 (FIG. 19) along the entire width thereof and even enables the marking of a somewhat inclined hem as indicated in FIG. 19. The device 10 is so used that it can mark the hem, not only in a front panel 16 of drapery 14 (FIGS. 5 and 16), but also in the lining panel 18. As indicated in FIG. 19 the finished drapery 14 has a top edge 19 as well as a hem 12, which parallels floor 20 with the drapery extending from sides 21 of a window.

Figure 2:
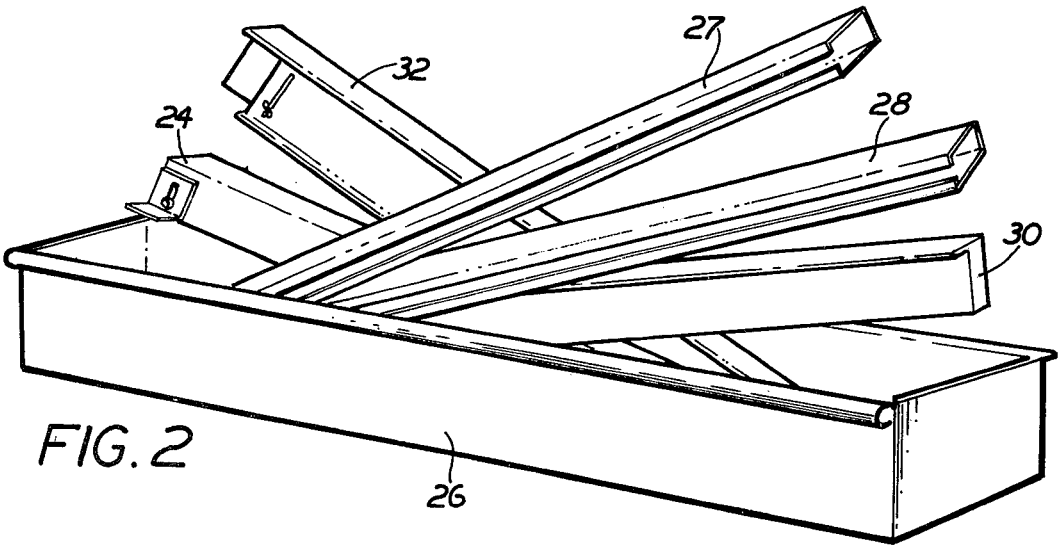
FIG. 2 is a view similar to FIG. 1, but showing the device about to be collapsed into the base thereof.

The basic details of device 10 are shown in FIG. 1 and comprise a top 24 and a base 26 which also functions as a container for the various components when not in use as indicated in FIG. 2. In order to do this, the base 26 is comprised of front, rear end panels as well as a floor (not shown).

The top 24 of device 10 is supported by left upright 27 and right upright 28 which are held in the end panels of the base 26 by screws 29 (FIG. 1).

Figure 3:
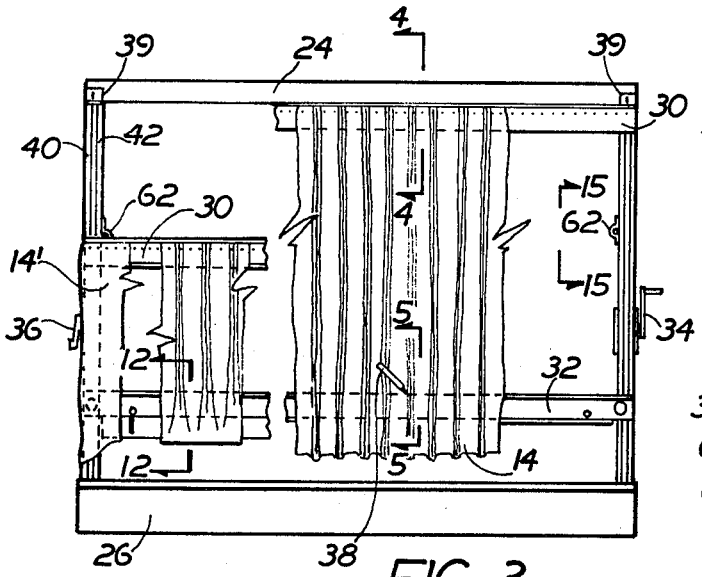
FIG. 3 is an elevational view with portions cut-away for the sake of clarity, of the device of the present invention showing the positioning on such device a drapery of normal length and a drapery of somewhat shorter length.
Figure 4:
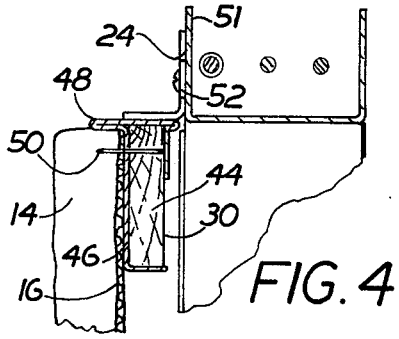
FIG. 4 and FIG. 5 are enlarged sectional views taken respectively along the lines 4—4 and 5—5 of FIG. 3.

As will be seen hereinafter, the top edge of the drapery is secured to a ceiling bar 30 that may be raised to an uppermost position against stops 39 as shown in FIG. 3 by means of crank 34. The drapery 14 is secured to the ceiling bar 30 through the use of parallel pins 50 as best indicated in FIG. 4. The actual procedure involves positioning the drapery 14 on the ceiling bar 30 by simply moving the upper edge of the drapery into contact with the pins 50 and then pushing the drapery against the pin 50 so that the upper edge of the drapery 14 lies against the top guide 48 (FIG. 4) of the ceiling bar. Thereafter, the ceiling bar with the attached drapery 14 is raised by actuation of crank 34 until the ceiling bar 30 contacts the ceiling bar stops 39 as indicated in FIG. 3. Various dimensions can be directly read from outer rule 40 that is located on uprights 27 and 28. The positioning of the ceiling bar against the stops duplicates the precise location of the ceiling of the area to which the finished drapery will be applied.

Figure 6:
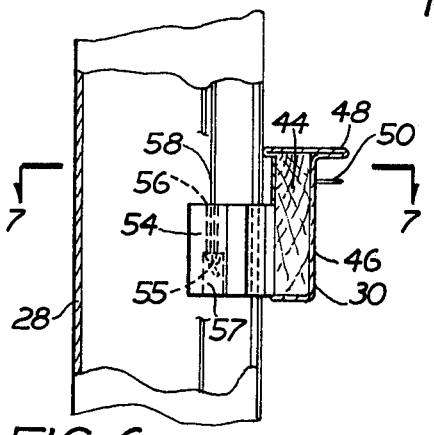
FIG. 6 is a sectional view taken of the ceiling bar to indicate attachment of the ceiling bar to a cable.
Figure 8:
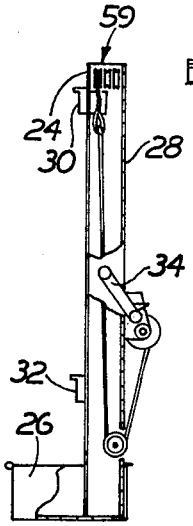
FIG. 8 is a sectional view through the right upright showing details of the ceiling bar crank.

Certain additional details of the ceiling bar 30 are shown in FIGS. 4, 6 and 8, wherein the ceiling bar 30 is composed of a wooden plank 44 which is inserted in hollow aluminum bar 46 which extends outwardly in a top guide 48.

The use of wooden plank 44 allows the operator to put push pins through the drapery to secure behind the ceiling bar, and also in order to perform additional operations such as to stretch the drapery or do additional types of work.

In an alternate embodiment of the invention (FIG. 4) an extension piece 51 for the ceiling bar is adjustably secured to the upper edge of top guide 48 so that the ceiling bar can be effectively raised on either side for squaring purposes to conform to the precise configuration of the upper portion of the window for which draperies are being prepared. For this purpose, an adjustment screw 52 is provided.

Figure 7:
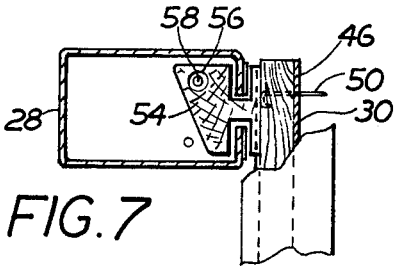
FIG. 7 is a sectional view taken along the lines 7—7 of FIG. 6.

Ceiling bar 30 is raised and lowered by actuation of the crank 34 which in turn caused raising or lowering of ceiling bar cable 58 which extends through opening 56 in ceiling block 54 as indicated by FIGS. 6 and 7. The cable 58 is secured to the block 54 and 55 which is located in a somewhat wider part 57 of opening 56. There is also a tension spring (not shown) that holds cable 58 in tension to keep the ceiling bar 30 in horizontal position through the use of pulleys to be discussed hereinafter. This spring is in block 54.

Figure 9:
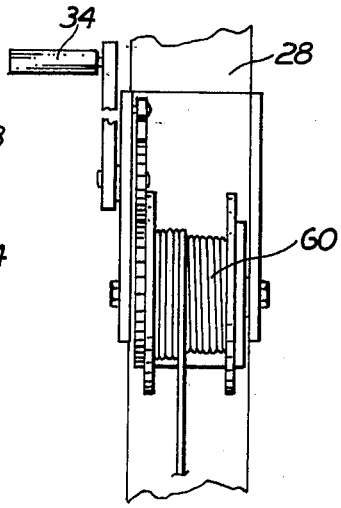
FIG. 9 is a sectional view similar to FIG. 8 but showing further details of the ceiling bar crank.
Figure 10:
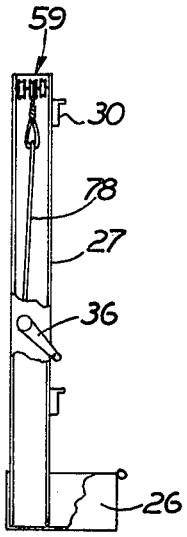
FIG. 10 and FIG. 11 are similar to FIGS. 8 and 9 but showing details of the drapery length indicator crank.
Figure 15:
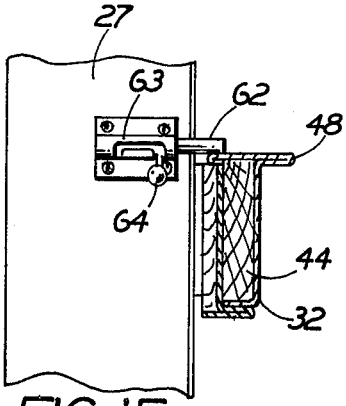
FIG. 15 is an enlarged view taken along the lines 15—15 of FIG. 3.
Figure 18:
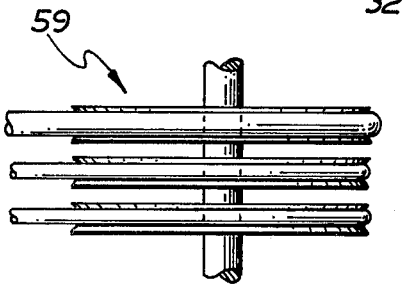
FIG. 18 is a view showing one set of pulleys.

The crank 34 from the ceiling bar is of conventional construction including a drum (FIG. 9) and the usual cable arrangement whereby a single cranking device 34 actually causes simultaneous raising or lowering of two cables 58 which are held in tension as previously discussed. One of the cables is attached adjacent one end of the ceiling bar 30 and the other of which is attached adjacent the other end of ceiling bar 30. These two cables utilize two of the three pulleys 59 as indicated in FIGS. 8 and 18. The three pulleys are rotatively mounted on a common shaft. The three pulleys 59 as indicated in FIG. 8 are positioned within upright 28 adjacent the upper edge thereof. A second set of pulleys 59 exists in upright 27 adjacent the upper end thereof (FIG. 10). With reference to FIG. 18 it will be appreciated that one of the cables will extend from a particular crank 34, then about one of the pulleys in upright 27 and then across to a pulley in upright 28 and then down to the ceiling bar. Another cable will simply pass about another of the pulleys, then down immediately to the closely adjacent end of the ceiling bar so that actuation of a single crank 34 will cause steady raising and lowering the ceiling bar 30. A similar arrangement is provided for the drapery length indicator through actuation of crank 36.

Where a shorter drape 14 is having its hem marked, a slidable stop 62 provided adjacent the inner surfaces of uprights 27 and 28 is ued to limit raising of the ceiling bar 30 to an intermediate position as indicated in the lefthand side of FIG. 3. For this purpose, inner rule 42 formed on each of the uprights 27 and 28, is utilized. The stops 62 can simply be slid into a retracted position when a full length drapery is being hemmed or the stop 62 can be slid to its operative position to limit the raising of the ceiling bar 30 where a short drapery is being hemmed. The usage of slidable stop 62 is shown in FIG. 15 wherein a knob 64 is used to move the stop back and forth between inner and outer positions through guide 63.

The details of the drapery length indicator 32 are shown in FIGS. 5, 12, 13 and 14. The drapery length indicator 32 is comprised of a wooden plank 65 which is inserted in hollow aluminum bar 66 being bent adjacent the upper edge of woodbar 65 into outer marking ledge 67 and inner marking ledge 68. As further indicated in FIG. 5 the outer marking ledge 67 enables an ultraviolet pencil to mark the place of the hem in front panel 16 by simple abutment. The mark made is invisible but is seen through the use of ultraviolet lamp 38. This process is repeated with reference to the lining panel through the use of the inner marking ledge 68.

The drapery length indicator is raised or lowered to a desired position by actuation of crank 36 with reliance upon the outer rule 40 or the inner rule 42 on each of the uprights 27 and 28. This enables the operator to acutate crank 36 until there is a desired height of the drapery length indicator. Drapery length indicator knobs 69 constituting holding means are provided at each end of the drapery length indicator. Each of the knobs 69 relies upon a threaded stem-wingnut arrangement so that the knob 69 can be tightened against the uprights whereby the drapery length indicator 32 is held rigidly against the uprights.

Furthermore, it is sometimes necessary that the hem be inclined in the manner of hem of FIG. 19. This can be done by tightening the left knob 69 against upright 27 at the precise place on left outer rule 40 corresponding to the left vertical dimension of the ceiling to floor distance of FIG. 19. The process is repeated for the righthand dimension since the drapery length indicator can effectively be held rigid in an inclined or tilted position to correspond with the variance in vertical dimension between the left and right sides of a window or other wall space as indicated in FIG. 19. Such a variance exists whenever the floor or ceiling is not absolutely horizontal.

Figure 17:
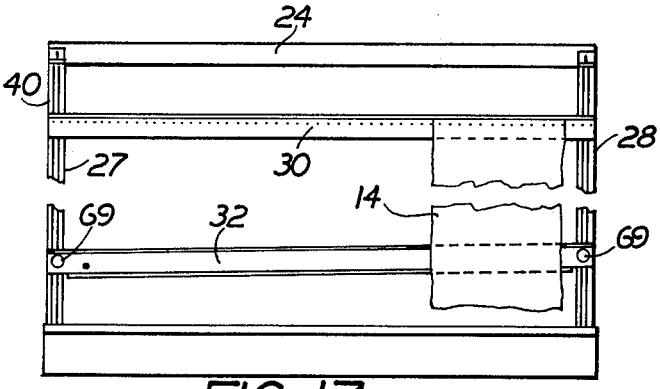
FIG. 17 is an elevational view showing relative positioning of the ceiling bar and drapery length indicator.

The tilting of the drapery length indicator is best shown in FIG. 17 wherein the vertical height of the drapery length indicator is first adjusted by actuation of crank 36 and the left knob 69 tightened against upright 27 in accordance with a selected place along outer rule 40. The right side of drapery length indicator is then raised the desired amount corresponding to the incline in the floor or ceiling and then the righthand knob 69 is tightened.

Figure 13:
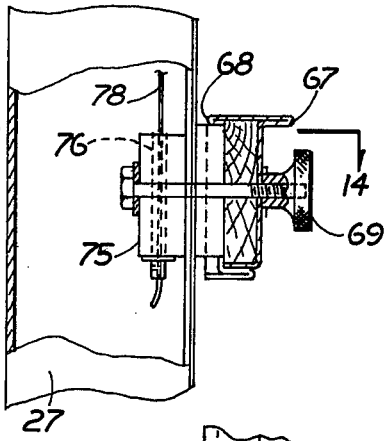
FIG. 13 is a sectional view showing further details of the drapery length indicator.
Figure 14:
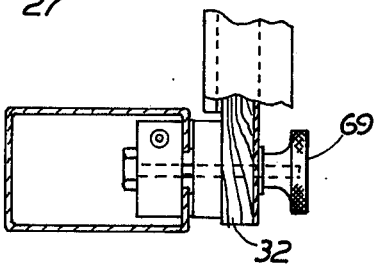
FIG. 14 is a sectional view taken along the line 14—14 of FIG. 13.

After the drapery length indicator is at a desired placement, ultraviolet lamp 38 is then pressed against the front panel of the drapery 14 in abutment against outer marking ledge 67. The ultraviolet lamp 38 is then run from one side of the drapery length to the other side in contact with the outer marking ledge 67. The process is then repeated for the lining by relying upon the inner marking ledge 68 and running the ultraviolet lamp from side to side against the inner marking ledge 68. The precise details of the tightening knob 69 are best shown in FIG. 13 or FIG. 14.

Where desired (FIG. 12) the drapery length indicator 32 may be provided with an extension 72 which is infinitely adjustable and held for a desired degree of extension by tightening of the wingnut 74. The extension piece 72 can be used in making deeper hems.

Figure 11:
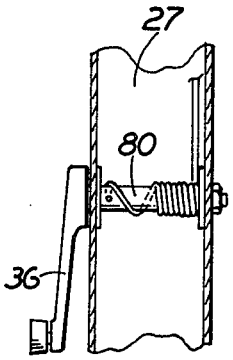
Figure 12:
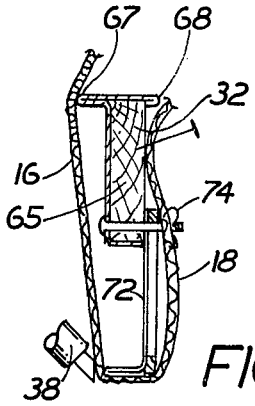
FIG. 12 is an enlarged sectional view taken along the lines 12—12 of FIG. 3.

The drapery length indicator is raised and lowered by means of crank 36 in precisely the same manner as the ceiling bar cable 58 including reliance upon two of the three pulleys adjacent the top of upright 27 and one of the pulleys adjacent the top of upright 28. The drapery length indicator cable 78 is secured to drapery length indicator cable attachment block 75 through an opening 76 in block 75 precisely the same manner and construction as with block 54. The drapery length indicator cable 78 is held in tension with the use of a spring (not shown) in block 75 for the same reason and in the same manner as cable 58. The cable 78 is wound on a drum 80 (FIG. 11) which is a part of the drapery length indicator crank 36. The interaction of the ceiling bar 30 and the drapery length indicator 32 with front panel 16 and lining panel 18 of drapery 14 is set forth in detail in FIG. 16.

While it is preferred that cranks be employed to raise and lower the ceiling drapery length indicator, it is also possible to substitute motorized mechanisms although the invention preferably deals with hand cranking means, winches or reduction gears to give better control than motorized devices and to minimize cost. The metallic materials utilized in the invention include appropriate aluminum bars or heavier steel for the structural members, as well as the base and the top.

Without further elaboration, the foregoing will so fully illustrate our invention that others may, be applying current or future knowledge, readily adapt the same for use under various conditions of service.

What is claimed as the invention is:

1. A drapery length marking device comprising a pair of uprights extending upwardly from a base, a ceiling bar and drapery length indicator adjustably secured to said uprights, means to move said drapery length indicator vertically with reference to said uprights, second means to move said ceiling bar vertically with reference to said uprights, with upward movement of said ceiling bar being limited by a stop adjacent the top of at least one of said uprights, said ceiling bar having a plurality of pin means to receive and hold a drapery, said drapery length indicator including a projecting outer marking ledge that is generally horizontally disposed, said drapery length indicator further possessing holding means adjustable at each end of said drapery length indicator adjacent said uprights, said holding means adjustably securing said drapery length indicator to said uprights to permit said drapery length indicator to be held in a desired position for purposes of marking a lower edge of a drapery corresponding to an area to be covered by the completed drapery whereby said drapery passes about the marking ledge of said drapery length indicator and a marking device for marking a line on said drapery by abutment of the marking device on said drapery and said marking ledge as the marking device is moved across the drapery.

2. The invention of claim 1 wherein said ceiling bar has a ledge contacting said stop so as to correspond with an outer rule positioned upon one of said uprights and to duplicate the ceiling where the finished drapery will be applied.

3. The invention of claim 2 and further including a slidable stop positioned below said first names stops to limit the raising of the ceiling bar to an intermediate position corresponding to an inner rule secured to one of said uprights.

4. The invention of claim 1 wherein said ceiling bar possesses a horizontally disposed top guide to assist in proper placement of the drapery on said pins in order to be square.

5. The invention of claim 1 wherein said drapery length indicator also possesses an inner marking ledge which is horizontally disposed for use in marking the hem on the lining of a drapery.

6. The invention of claim 1 wherein said ceiling bar possesses an extension base for squaring and said drapery length indicator possesses an extension piece for use in making deeper hems.

7. The invention of claim 1 wherein said holding means comprises tightening knobs allowing a degree of displacement of the drapery length indicator to mark a non-horizontal hem.

8. The invention of claim 1 wherein said ceiling bar and drapery length indicator are raised and lowered by separate hand operated cranking means.

9. The invention of claim 8 including cables actuated by said cranking means, said cables being held in tension and leading to blocks which are attached to and cause movement of a ceiling bar or drapery length indicator.

10. The invention of claim 1 wherein said marking means produces a mark that is visible only under an ultraviolet lamp.

* * * * *